US006992314B2

(12) United States Patent
Masaki et al.

(10) Patent No.: US 6,992,314 B2
(45) Date of Patent: Jan. 31, 2006

(54) DEVICE FOR ELIMINATING ELECTROMAGNETIC WAVES

(75) Inventors: Kazuya Masaki, Okayama (JP); Ken Hayashibara, Okayama (JP)

(73) Assignee: Kabushiki Kaisha Shunkosha, Okayama (JP)

( * ) Notice: Subject to any disclaimer, the term of this patent is extended or adjusted under 35 U.S.C. 154(b) by 133 days.

(21) Appl. No.: 10/654,660

(22) Filed: Sep. 4, 2003

(65) Prior Publication Data

US 2004/0041106 A1 Mar. 4, 2004

Related U.S. Application Data

(63) Continuation-in-part of application No. 10/179,278, filed on Jun. 26, 2002, now abandoned.

(30) Foreign Application Priority Data

Jun. 26, 2001 (JP) ..... 2001-192967

(51) Int. Cl.
*H01Q 17/00* (2006.01)
*H01Q 11/08* (2006.01)

(52) U.S. Cl. ..... 250/505.1; 361/220; 342/1; 342/2; 342/3; 342/4

(58) Field of Classification Search ..... 250/505.1, 250/515.1; 128/846; 342/1–4; 361/220, 361/230

See application file for complete search history.

(56) References Cited

U.S. PATENT DOCUMENTS

| | | | | |
|---|---|---|---|---|
| 2,969,484 A | | 1/1961 | Suckow | |
| 4,928,201 A | * | 5/1990 | Wright et al. | 361/215 |
| 5,086,369 A | | 2/1992 | Lin | |

FOREIGN PATENT DOCUMENTS

| | | |
|---|---|---|
| DE | 9102248 | 8/1991 |
| WO | WO 9806453 | 2/1998 |

* cited by examiner

*Primary Examiner*—John R. Lee
*Assistant Examiner*—David A. Vanore
(74) *Attorney, Agent, or Firm*—Browdy and Neimark, PLLC

(57) ABSTRACT

Disclosed is a device for eliminating electromagnetic waves which consists essentially of an electromagnetic-wave trapping means comprising mainly a coil, and a discharge means made on the opposite end to the basement of the trapping means, wherein the coil having a diameter which gradually decreases from the basement to the opposite end of the trapping means.

2 Claims, 2 Drawing Sheets

DEVICE FOR ELIMINATING ELECTROMAGNETIC WAVES

This is a continuation-in-part of parent application Ser. No. 10/179,278, filed Jun. 26, 2002. Abandoned.

BACKGROUND OF THE INVENTION

1. Field of the Invention

The present invention relates to a device for eliminating electromagnetic waves, particularly, to a device for eliminating electromagnetic waves, which uses a coil as an electromagnetic-wave trapping means.

2. Description of the Prior Art

In this complicated contemporary society, in addition to mental stresses such as tension, suppression, anxiety, complaint, anger, and frustration, the stresses (so called "Technostress") which are induced by electromagnetic waves radiated from cellular phones, television sets, video displays, information displays, automobiles, electric trains, etc., have been increasing as their prevalence. Recently, undesirable influence of electromagnetic waves on living bodies has been discussed from another viewpoint, resulting in a proposal, for example, of tools for shielding electromagnetic waves such as aprons for shielding electromagnetic waves and front panels for information displays, which are used after being applied to living bodies or installed in a part of articles. However, partial shielding of living bodies and articles by the aprons or the front panels would not be sufficient to attain the desired effect when exist a quantity of sources which radiate electromagnetic waves to the inside and outside of residence spaces.

SUMMARY OF THE INVENTION

The object of the present invention provides a simple/handy device for eliminating electromagnetic waves, which eliminates or reduces electromagnetic waves in residence spaces only by placing it in appropriate places of residence spaces such as rooms.

The present inventors energetically studied and screened, revealing that, in spite of its simple construction, a device for eliminating electromagnetic waves, which consists essentially of (i) an electromagnetic-wave trapping means comprising mainly a coil having a diameter that decreases gradually from the basement to the opposite end of the coil, and (ii) a discharge means made on the opposite end to the basement of the electromagnetic-wave trapping means, eliminates or reduces electromagnetic waves in residence spaces such as rooms only by placing it in appropriate places thereof.

Accordingly, the present invention solves the above object by providing a device for eliminating electromagnetic waves, which consists essentially of an electromagnetic-wave trapping means comprising mainly a coil having a diameter that decreases gradually from the basement to the opposite end of the coil, and a discharge means made on the opposite end to the basement of the trapping means.

BRIEF EXPLANATION OF THE ACCOMPANYING DRAWINGS

EXPLANATION OF SYMBOLS

1 Electromagnetic-wave trapping means
2 Coil
3 Discharge means
4 Supporting means
5 Periphery
6 Plumb

DETAILED DESCRIPTION OF THE INVENTION

Figure 1:
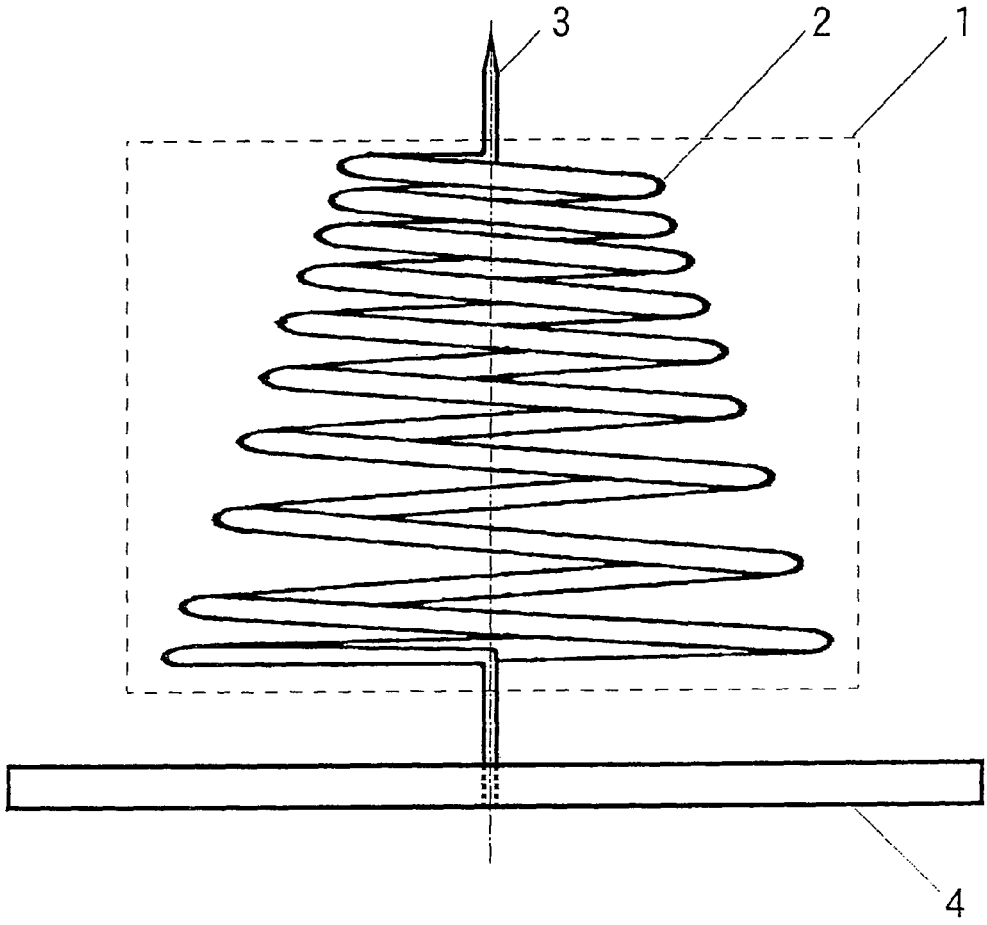
FIG. 1 is a brief drawing of a preferred embodiment according to the present invention.

The present invention is explained with reference to a preferred embodiment according to the present invention. FIG. 1 shows a brief drawing of a preferred embodiment according to the present invention, wherein 1 means an electromagnetic-wave trapping means which traps/collects electromagnetic waves and converts them into alternating voltages and which is mainly constructed by a coil 2. On the opposite end to the basement of the electromagnetic-wave trapping means 1, a discharge means 3 for discharging the voltages generated at the electromagnetic-wave trapping means 1 is made, and the trapping means 1 is held roughly perpendicularly by putting the basement edge of the trapping means 1 to a supporting means 4 made of a non-electro-conductive material.

The coil 2, as a main component of the electromagnetic-wave trapping means 1, can be prepared by forming into a helical shape a material, for example, metals such as iron, cobalt, nickel, platinum, copper, silver, gold, aluminum, and zinc; and alloys thereof; electro-conductive plastics; and appropriate electro-conductive wiring materials obtained by combining non-electro-conductive materials such as non-electro-conductive plastics with the above electro-conductive materials by the methods such as electroplating, spattering, vacuum deposition, and chemical deposition. To improve the discharge efficiency, the coil 2 is formed so as to gradually reduce its diameter from the basement to the opposite end of the coil 2 in such a manner of allowing the diameter of basement of the coil 2 to give 1.2-times, preferably, 1.5–3 times of that of a part near the opposite end to the basement of the coil 2. The direction of coil winding of the coil 2 can be made in the clock-wise direction, i.e., right direction, or the anti-clock-wise direction, i.e., left direction, however, it is preferably set to the anti-clock-wise direction in the Northern hemisphere in view of the influence of geomagnetism. The number of turns of the coil winding can be increased or decreased, usually, in the range of at least two turns, preferably, 3–30 turns. To afford a space capacity for trapping electromagnetic waves, the coil 2 is preferably made to give a gap between the coil windings of the coil 2. Although the diameter of the coil 2 is not specifically restricted, in the case of using a wiring material having a smaller diameter, the coil 2 is optionally allowed to twist spherically around the periphery, for example, of conoid supporting means made of non-electro-conductive materials such as non-electro-conductive plastics to allow the coil 2 to keep its desired shape and structure. If necessary, the surface of the wiring material for the coil 2 can be coated with paints comprising electromagnetic-wave absorbing materials such as ferrite.

In this embodiment, the discharge means 3, made on the opposite end to the basement of the electromagnetic-wave trapping means 1, is prepared by extending both the termini, i.e., the starting and terminating ends of the coil 2 to give an appropriate length in the longitudinal direction or in the perpendicular direction to the horizontally positioned coil windings of the coil 2, among which the extended edge positioning to the opposite end to the basement of the trapping means 1 is used as the discharge means 3. While the extended edge of the coil 2 positioning to the side of the basement of trapping means 1 is used as a putting means which is inserted into an insertion hole perforated in appropriate positions on the supporting means 4 to allow to perpendicularly hold the whole body of the device for eliminating electromagnetic waves. To increase the discharge efficiency, the terminus of the discharge means 3 can be shaved into a semispheric shape, conical shape or the like, and optionally the surface of the resulting terminus can be ground or installed with a radiator in a radial form made of a electro-conductive material(s).

Figure 2:
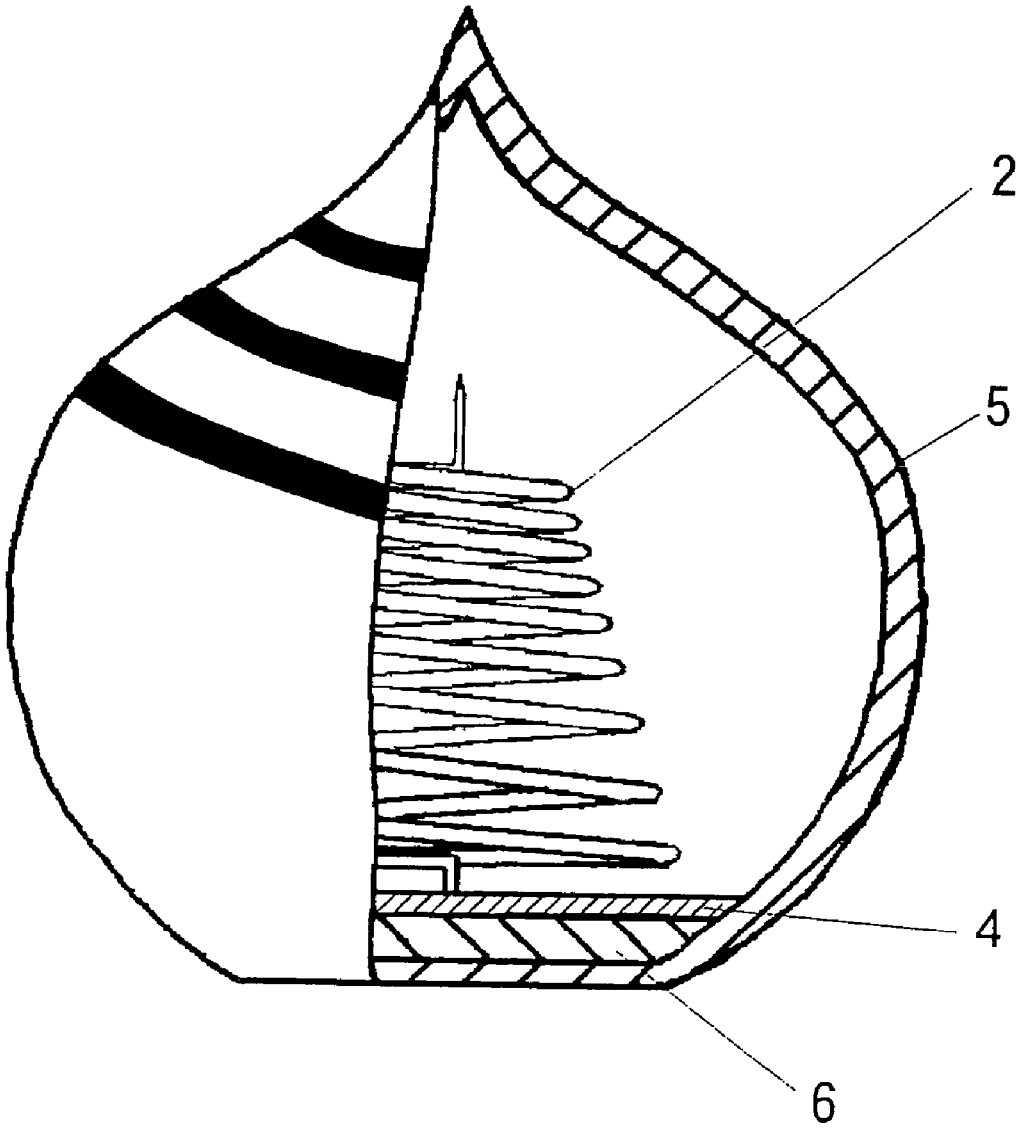
FIG. 2 is a brief drawing of a preferred embodiment of the body of the device for eliminating electromagnetic waves enclosed in a supporting means in the form of an orb according to the present invention.

Any materials and shapes of the supporting means 4 can be used in the present invention as long as they trap/collect electromagnetic waves when installed and used in the device for eliminating electromagnetic waves of the present invention, and hold the body of the device approximately perpendicularly. Accordingly, in addition to the supporting means 4 in FIG. 1, another ones can be made by appropriately combining, for example, with woods, bamboos, papers, cloths, non-wovenfabrics, plastics, glasses, earthenwares, porcelains, and stones. Depending on the places to be positioned, as shown in FIG. 2, the device for eliminating electromagnetic waves of the present invention can be arbitrarily covered with a housing 5 formed in an appropriate shape, for example, eggs, fruits, balls, indoor shrines, dolls, stuffed, tumblers, rockets, Buddhist stupas, and orbs, to suit the atmosphere of residence spaces to be applied. In this case, if necessary, a plumb 6 can be provided in the inner basement of the housing 5 or the device of the present invention can be stably put by injecting into the inner space of the housing 5 organic- or inorganic-materials which have been shaped into particles, granules or fibers. Needless to say, the materials of the housing 5 are selected from those which have no ferromagnetism, preferably, non-electro-conductive materials so as not to hinder the collection of electromagnetic waves by the electromagnetic-wave trapping means 1.

Explaining the use of the device for eliminating electromagnetic waves in this example, the device is placed in or around shoe boxes, tables, desks, fireplaces, make-up stands, tableware shelves, chest of drawers, buddhist altars, television sets, personal computers, and microwave ovens with keeping the electromagnetic-wave trapping means roughly perpendicularly. When used in larger residence spaces, a plurality of the devices of the present invention can be placed in four corners of the residence spaces or placed at appropriate places therein by differentiating the positions of the devices to be placed to give different heights from the floor. Alternatively, the devices can be placed in appropriate positions such as ceilings and walls at an appropriate interval using auxiliary aids in the form of an L-, T-, and U-letter forms and the like. Thus, electromagnetic waves in the residence spaces are trapped by the electromagnetic-wave trapping means 1, then converted into alternating voltages and discharged in the air from the discharge means 3, resulting in significant elimination or reduction of electromagnetic waves in the residence spaces.

As described above, the device for eliminating electromagnetic waves of the present invention, which is constructed in a relatively simpler manner, has the actual merit that it eliminates or reduces electromagnetic waves in residence spaces only by placing it at appropriate places in residence spaces such as rooms.

While there has been described what is at present considered to be the preferred embodiments of the invention, it will be understood the various modifications may be made therein, and it is intended to cover the appended claims all such modifications as fall within the true spirits and scope of the invention.

We claim:

1. A device for eliminating electromagnetic waves, which consists essentially of an electromagnetic-wave trapping means comprising mainly a coil made of electro-conducting material and a supporting means made of a non-electro-conductive material; said trapping means being roughly perpendicularly held on said supporting means by putting the basement of said trapping means to said supporting means; the opposite end to the basement of said trapping means being used as a discharge means; and said coil having a diameter which decreases gradually from the basement to the opposite end of said electromagnetic-wave trapping means.

2. The device of claim 1, wherein said coil is formed so as to gradually reduce its diameter from the basement to the opposite end of said coil in such a manner of allowing the diameter of basement of said coil to give at least 1.2-times of that of a part near the opposite end to the basement of said coil.

* * * * *